United States Patent [19]

Iwaoka et al.

[11] 4,149,158

[45] Apr. 10, 1979

[54] SECURITY SYSTEM FOR CATV TERMINAL

[75] Inventors: Takeshi Iwaoka; Shigeki Koike, both of Tokyo, Japan

[73] Assignee: Pioneer Electronic Corporation, Tokyo, Japan

[21] Appl. No.: 795,378

[22] Filed: May 10, 1977

[30] Foreign Application Priority Data

May 11, 1976 [JP] Japan ..... 51-53665

[51] Int. Cl.[2] ..... G08B 13/02

[52] U.S. Cl. ..... 340/568; 340/506; 340/531; 325/308; 339/37; 358/114

[58] Field of Search ..... 340/65, 213 R, 280, 340/282, 409, 416, 256; 358/86, 114; 339/36, 37; 325/308

[56] References Cited

U.S. PATENT DOCUMENTS

| | | | |
|---|---|---|---|
| 3,794,989 | 2/1974 | Manley et al. | 340/280 |
| 3,824,541 | 7/1974 | Nolan | 340/65 |
| 4,009,474 | 2/1977 | Eller | 340/280 |

*Primary Examiner*—Alvin H. Waring
*Attorney, Agent, or Firm*—Fraser and Bogucki

[57] ABSTRACT

In a CATV terminal, in which it is desired to maintain privacy or security, the cover of the terminal must be removed in order to permit access to the terminal interior. In accordance with the invention, however, removal of at least one of the cover screws causes shifting of a spring loaded movable member that normally receives or is retained by the screw. The shifting movement operates a switch, causing transmission of a signal to the head end that indicates that an entry has been made to the terminal. In one form the movable member itself is threaded to receive the cover screw, and in another form the movable member is arranged to be initially aligned by limit stops, then released from the limit stops and preloaded against the restraint of the cover screw. In either form the mechanism can be arranged such that the screw cannot be reinserted to provide a positive indication of tampering. Also, a special device may be used by an authorized individual to reset the mechanism when appropriate provision is made.

8 Claims, 6 Drawing Figures

SECURITY SYSTEM FOR CATV TERMINAL

BACKGROUND OF THE INVENTION

The invention relates to a CATV terminal unit and, more particularly, to a two-way CATV terminal unit for providing effective means to detect when the subscriber or a third party opens the terminal unit cover to possibly alter its interior mechanism.

Most conventionally used CATV systems have been of a one-way type in which a center unilaterally transmits a plurality of television programs through a number of channels and the subscriber can view the program by operating a converter to convert each channel to a vacant channel (a channel having no television broadcasting) of his television receiver. In this case, however, it is very difficult to record what program has been viewed and how long a subscriber has viewed the program and therefore the system manager has been obliged to uniformly charge the subscribers on a periodic usage basis. In order to provide expensive programs, such as films that are high in production cost or newly released, to specified subscribers only, a system has been also used in which the subscriber an view the special program by inserting into the converter (terminal unit) a key or a specially processed card which is hired or sold. However, this system is troublesome for both the system manager and the subscriber.

The apparatus for detecting removal of the CATV terminal unit cover in accordance with the present invention is premised on an assumption that the apparatus is used with a new system free from the disadvantages found in the conventional CATV system. The new system referred herein is generally such that its head end is connected through two-way transmission paths to tens of thousands of terminal units each numbered differently from one to another and is associated with a computer for sequentially calling up the respective terminal units (this operation is herein referred to as polling) and for collecting coded data signals indicating the respective terminal unit states such as which channel is viewed. A system having its head end capable of determining the status of the respective terminal units at frequent intervals permits making a charge to the subscriber for every channel and for every program viewed. Furthermore, in the case where keys are lent to specified subscribers in order to prevent general subscribers or minors from viewing a certain channel, such a system can detect in polling (1) whether or not the terminal unit is owned by the subscriber having the key, (2) whether or not the key is inserted into the converter, and (3) whether or not the subscriber views the special program requiring the key. This is very convenient for system management. However, the system also involves difficult problems such that where a person removes the terminal unit cover from the terminal unit and alters its interior mechanism without permission, that person can view the special program and the head end cannot establish a correct account of the charge to him.

Therefore, the present invention has for its object to provide a satisfactory solution of the above mentioned problems.

It is another object of the present invention to provide a terminal unit for CATV systems which can inform the head end whenever the subscriber or third party opens the terminal unit cover.

It is still another object of the present invention to provide a cover removal detecting apparatus for CATV terminal units which is easy to manufacture.

It is still another object of the present invention to provide a cover removal detecting apparatus for CATV terminal units in which as soon as the person takes a screw bolt off a screw hole to open the unit cover, the scre whole is closed to prevent the screw bolt from being screwed into the screw hole again and at the same time this condition is informed to the head end.

It is still another object of the present invention to provide a cover removal detecting apparatus for CATV terminal units in which after the cover is removed once from the terminal unit, it is difficult for members of the general public to set the cover to its initial condition and it is easy for service men to do so.

SUMMARY OF THE INVENTION

In a CATV terminal unit, the housing for the electronic assembly is encompassed by a cover, to which it is joined by a coupling element. Removal of the coupling element is detected, and a signal is generated that is transmitted to the dead end for indicating that access has been gained to the housing. In particular arrangements in accordance with the invention, a spring loaded movable member disposed within the housing is normally restrained from movement by a fastening member coupling the cover to the housing. When the fastening member is removed, however, the lever is free to shift against a switch actuator, generating the signal for ultimate transmission to the head end.

In accordance with other aspects of the invention, a movable plate may be disposed so as normally to be engaged by a coupling means or screw bolt when in position. The movable plate is spring biased in the direction away from a limit stop which defines the initial alignment position of the movable plate relative to the screw bolt, but the limit stop is released and the plate is restrained only by the bolt after it is inserted. When the screw bolt is removed, however, the movable plate shifts to a different position, actuating the switch. The arrangement may permit reentry of the bolt, or close off the hole so as to provide a positive indication of tampering. Furthermore, the mechanism may include a control aperture in either the cover or housing or both, through which a specially configured control member may be inserted by an authorized service person, so as to shift the movable plate back into position and permit reinsertion of the screw bolt.

BRIEF DESCRIPTION OF THE DRAWINGS

A better understanding of the invention, as well as the invention itself, may be had by reference to the following description, taken in conjunction with the accompanying drawings, in which.

DETAILED DESCRIPTION OF THE INVENTION

Figure 1:
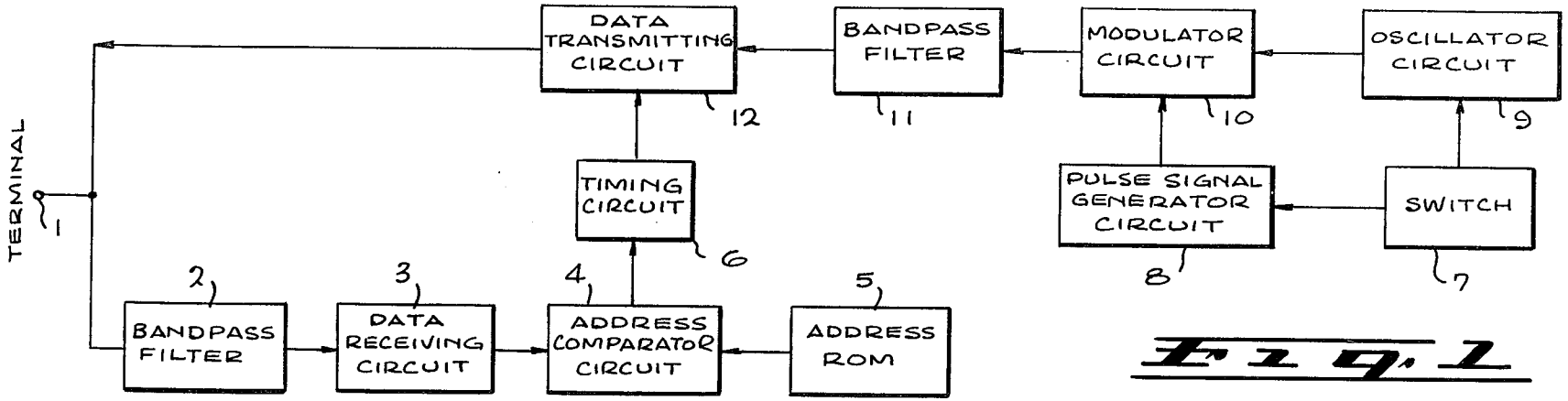
FIG. 1 is a block diagram showing a data transmitting section of a terminal unit in accordance with the present invention.

Reference will be made hereinafter in detail with reference to the accompanying drawings which illustrate exemplifications of the present invention. FIG. 1 is a block diagram showing a data communication section of a terminal unit wherein a section for receiving television signals from the head end is omitted for brevity. A terminal 1 is connected via a coaxial cable (not shown) from the head end and passes signals to a bandpass filter 2 for selecting a data signal (for example, a pulse signal having a 115.25 MHz carrier signal) transmitted from the head end to the terminal 1. A data receiving circuit 3 performs the function of demodulating the signal that is passed through the bandpass filter 2 to an address comparator circuit 4, which also receives an input from an address ROM 5. The address ROM 5 stores a coded address member previously assigned to the terminal unit and the address comparator circuit 4 produces an output signal when the coded address number and the address signal are in accord to thereby detect that a calling signal is transmitted from the head end to the terminal unit. A timing circuit 6 for controlling the operation of a data transmitting circuit 12 to be described later receives signals form the comparator circuit 4. In the terminal, a switch 7 is adapted to be turned in when the terminal unit cover is opened, and a pulse signal generator circuit 8 is coupled to generate pulse signals when the switch 7 is in its ON state, the switch 7 also controlling an oscillator circuit 9 for producing signals (for example, 25 MHz sine waves) when the switch 7 is in the ON state. A modulator circuit 10 modulates the output of the oscillator circuit 9 in accordance with the pulse signal from the pulse signal generator circuit 8 for placing the pulse signal from the pulse signal generator circuit 8 on the carrier from the oscillator circuit 9. After passing through a bandpass filter 11, the data transmitting circuit 12 transmits signals fed through the bandpass filter 11 from the modulator circuit 10 to the cable through the terminal 1 while a control signal is supplied from the timing circuit 6.

When a downstream signal is transmitted from the head end to the terminal unit, the signal is applied from the terminal 1 through the bandpass filter 2 to the data receiving circuit 3 in which the signal is read as data. When the address number is in accord with the number stored in the address ROM 5, the timing circuit 6 operates to cause the data transmitting circuit 12 to effect its data transmitting operation. At this time, the switch 7 remains in its OFF state if the terminal unit cover remains closed, whereas th switch 7 is turned on if the terminal unit cover is opened so that the pulse signal generator circuit 8 generates a pulse signal, causing the modulator circuit 10 to modulate the 25 MHz carrier produced from the oscillator circuit 9. The signal is then fed through the bandpass filter 11 and the data transmitting circuit 12 to the head end.

Figure 3:
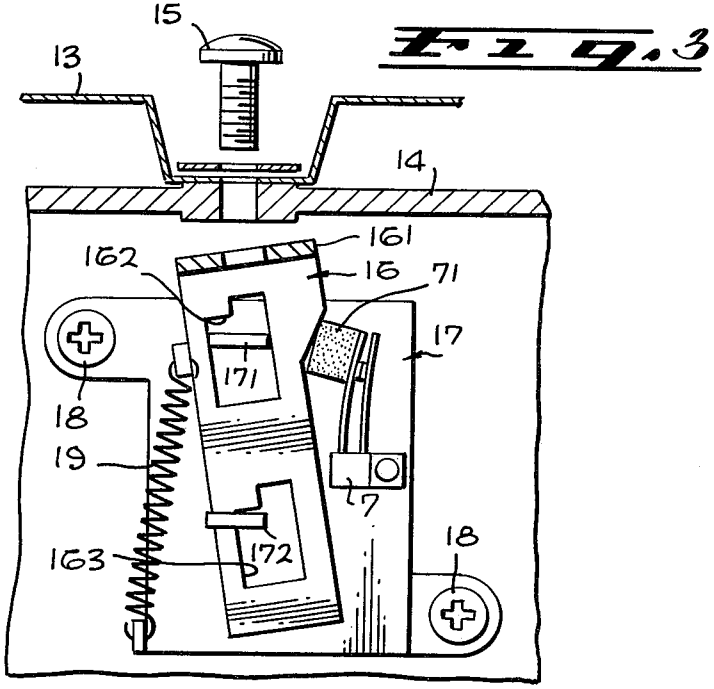
FIG. 3 is a sectional view showing another condition where a screw bolt is removed and the switch is in its ON state.
Figure 2:
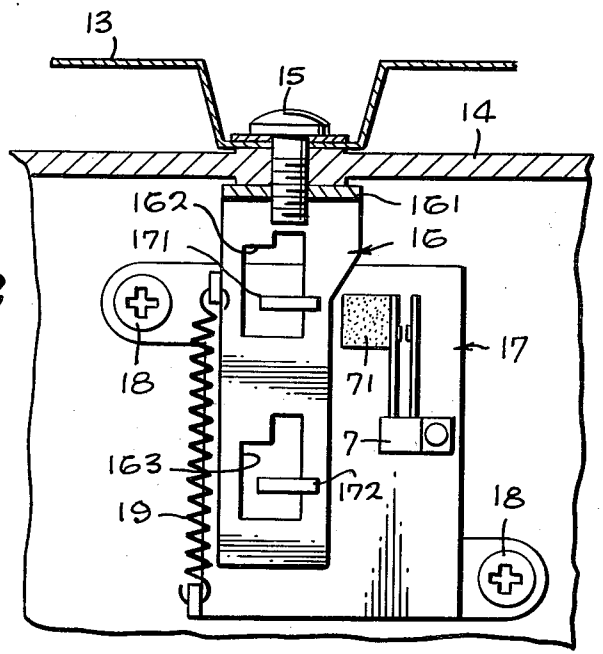
FIG. 2 is a sectional view showing a condition where a terminal unit cover is closed and with a switch in a normal state.

FIGS. 2 and 3 show the arrangement and operation of the switch 7. FIG. 2 shows a normal condition in which the terminal unit cover remains closed and FIG. 3 shows the condition in which the terminal unit cover is opened and thereby the switch 7 is turned on. In FIGS. 2 and 3, the reference numeral 13 indicates a terminal unit cover encompassing a chassis plate 14 forming part of a terminal unit housing, and fastened to the cover 13 by a screw bolt 15. A lever 16 is disposed next to a retainer plate 17 fixed to the chassis 14 by means of screws 18. The lever 16 is formed with openings 162 and 163 into which angled portions 171 and 172, respectively of the retainer 17 are inserted loosely. A spring member 19 is provided between the lever 16 and the retainer 17 to bias the lever 16 counterclockwise. The switch 7 is fixed to the retainer 17 and a buffer and an insulator rubber means 71 is attached such as by adhesive to one switch arm near the lever 16.

The lever 16 has a threaded upper portion 161 normally coupled to the cover 13 and the chassis 14 by means of the screw bolt 5 and under this condition the switch 7 remains in its OFF state. On the other hand, if the screw bolt 15 is taken off in order to remove the cover 13 and to reach the interior mechanism of the terminal unit, the lever 16 is released from the screw bolt 15 to rotate counterclockwise, being guided by the angled portions 171 and 172 of the retainer 17 as the force of the spring member 19 acts upon the lever. The lever 16 comes to rest in the position illustrated in FIG. 3 under control of the angled portions 171 and 172, which also function as limit stops. In this position, the lever 16 pushes the rubber member 71 to the right so as to turn the switch 7 on. At the same time, the screw hole formed in the turned portion 161 of the lever 16 becomes out of alignment with the bolt inserting path so as to make it impossible to insert the screw bolt 15 again without returning the lever 16 to its initial position. Thus the switch 7 is held in the ON state and the circuit described in connection with FIG. 1 continues to generate signals. Thus, the head end system can be notified of the removal of the cover 13 from the terminal unit when polling.

In accordance with the present invention, as described hereinbefore, the head end can know the condition where the subscriber or third party opens the terminal unit cover and can immediately undertake a proper response such as to stop transmitting television signals to the terminal unit, to transmit a warning signal to the terminal unit from the head end, or to cause the computer to automatically count additional charge as a forefeit. However, the mechanism may be arranged to permit reinsertion of the screw bolt, by guiding the lever 16 to an in line position with the screw bolt hole. Because the polling operation is carried out at high rates, practically all accesses will be detected even if the cover is replaced relatively quickly.

Figure 4:
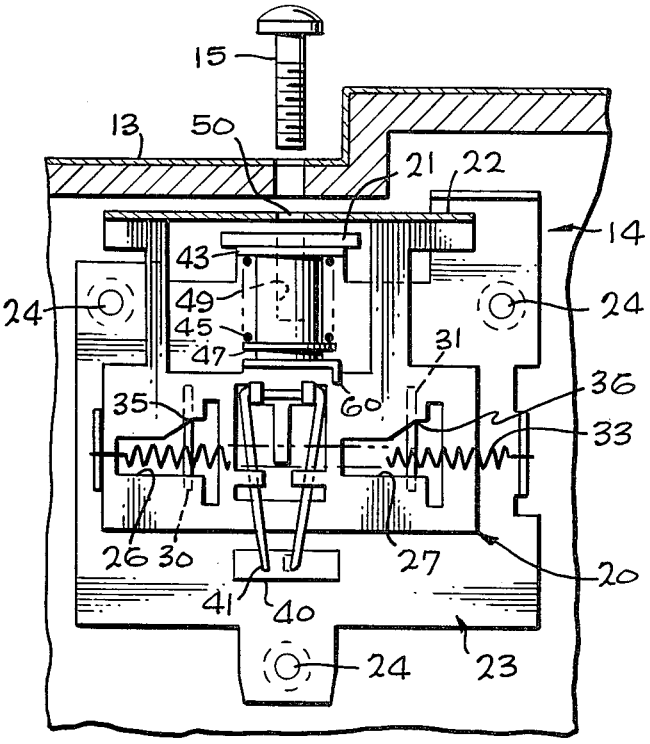
FIG. 4 is a sectional view of a cover removal detecting apparatus for CATV terminal units in accordance with another exemplification of the present invention with a terminal unit cover not yet attached.
Figure 5:
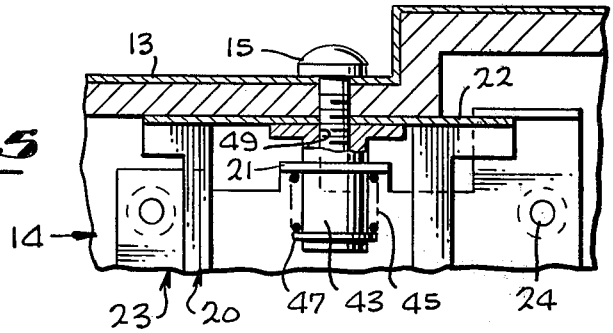
FIG. 5 is a sectional view of the cover removal detecting apparatus with the terminal unit cover being attached.
Figure 6:
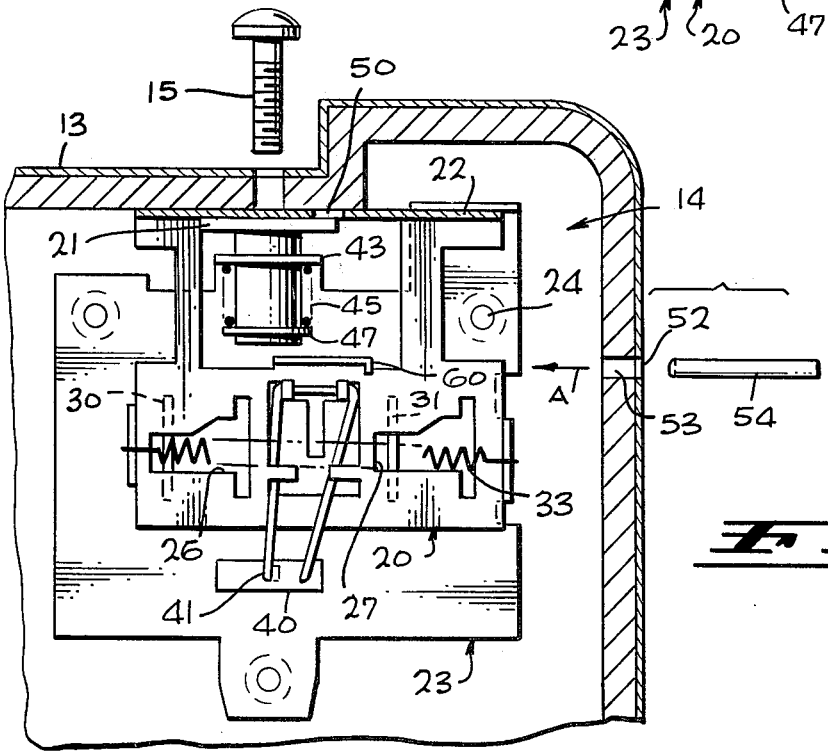
FIG. 6 is a sectional view of the cover removal detecting apparatus with the screw being taken off for removal of the terminal unit cover, and with the screw hole being covered so that the screw cannot be reinserted.

In the mechanism of FIG. 4, a first condition is shown wherein a cover is out on a terminal unit and is to be attached thereto. In FIG. 5 a second condition is shown where the cover is attached to the terminal unit, and FIG. 6 shows a third condition where a screw bolt is removed from a screw hole for removal of the cover.

In FIG. 4, the reference numeral 13 indicates a terminal unit cover (protective case), to which a chassis 14 is attached or at least adjacent. A screw bolt 15 inserted from outside the cover 13 also extends through a movable plate 20 at an upper angled portion 22 to engage a bushing 21 by means of the screw bolt. A fixed retainer plate 23 is coupled to the chassis 14 by means of screws 24. The movable plate 20 is formed with openings 26 and 27 through which angled stop portions 30 and 31 of the retainer plate 23 are loosely inserted, respectively. A spring member 33 is provided between the movable plate 20 and the retainer plate 23 so as to bias the movable plate 20 to the right (as seen in the Figures). The openings 26 and 27 are provided with limit stop corners 35 and 36, respectively, to be used in holding the movable plate 20 in the position illustrated in FIG. 1 during initial alignment. A switch 40 is attached to the retainer plate 23 to be turned on and off by movement of a two-armed pin spring member 41 fixed to the movable plate 20. The retainer plate 23 has an upper angled portion 43 with a hole through which a body portion of the bushing 21 extends toward the angled portion 22 of the movable plate 20. A cylindrical spring member 45 is loosely wound around the outer periphery of the body portion of the bushing 21 between the angled portion 43 of the retainer plate 23 and a ring 47 fixed to one end of the body portion of the bushing 21. Inside the body portion there is formed a screw hole 49 through which the screw bolt 15 is screwed. Thus the bushing 21 is urged downwardly (as seen in these Figures), resting at its lowest position against a portion of the movable plate 20.

When the screw bolt 15 is screwed to fasten the cover 13 to the chassis 14 fixed within the terminal unit housing, the screw bolt 15 comes into mesh with the bushing 21 and moves the bushing 21 upwards against the force of the spring member 45 so as to couple together the cover 13, the angled (upper) portion of the chassis 14, and the angled portion 22 of the movable plate 20. Under the condition illustrated in FIG. 1 where the screw bolt 15 is to be screwed in, the stop corners 35 and 36 are in engagement with the respective angled portions 30 and 31 of the retainer plate 23 so that the movable plate 20 is retained in the illustrated position although the movable plate 20 is biased to the right by means of the spring member 33. In this condition, a hole 50 formed in the angled portion 22 of the movable plate 20 is aligned with the screw hole and thus the screw bolt 15 can be readily screwed into the bushing 21. With the movement of the screw bolt 15 into the bushing 21, the movable plate 20 moves upwardly so that the limit stop corners 35 and 36 are released from engagement with the respective angled portions 30 and 31 of the retainer plate 23. At this time, the movable plate 20 still cannot move to the right by the force of the spring member 33 since it has been aleady retained by the screw bolt 15.

In this manner, the cover 13, the upper portion of the chassis 14, and the angled portion 22 of the movable plate 20 can be fastened tightly in a unit by the screw bolt 15 and the bushing 21 as shown in FIG. 5. When the screw bolt 15 in this state is taken off for the purpose of removal of the cover 13 from the terminal unit, the movable plate 20 moves to the right by the force of the spring member 33 as soon as the screw bolt 15 is taken off as shown in FIG. 6 since the stoppers 35 and 36 have been already released from the engagement with the respective angled portions 30 and 31. At the same time the switch 40 is changed from its OFF state to its ON state by the operation of the pin spring member 41.

At this time the hole 50 formed in the angled portion 22 of the movable plate 20 also moves to the right and is placed out of alignment with the screw hole 49 of the bushing 21 so that the screw hole 49 is closed off by the angled portion 22 of the movable plate 20. Since the instant the screw bolt 15 is taken off before the cover 13 is removed from the terminal unit the switch 33 effects its detecting operation and at the same time the movable plate 20 closes the screw hole 49 so as to prevent the screw bolt 15 from being screwed again, the swtich 40 can remain in its ON state.

Although the switch 40 is turned on only by taking the screw bolt 15 off before removing the cover 13 from the terminal unit, this condition is not necessary to be detected where a repairman or service man removes the cover 13 for the purpose of repair. Therefore, a control hole 52 is formed in the cover 13 and a corresponding hole 53 is formed in the adjacent portion of the chassis 14 in correspondence to the control hole 52 so that a rod 54 can be inserted through the holes 52 and 53 in the direction indicated by the row A in FIG. 6 to abut against an angled portion 60 of the movable plate 20. When the rod 54 is inserted to push the turned portion 60 of the movable plate 20 against the force of the spring member 33, the movable plate 2 moves to the position illustrated in FIG. 4 so that the limit stop corners 35 and 36 come into engagement with the respective angled portions 30 and 31 and the switch 40 is turned off.

As described hereinbefore in accordance with the present invention, the condition where the subscriber or third party removes the cover for the terminal unit can be detected as soon as he takes the screw bolt off. Furthermore, since the limit stop corners 35 and 36 are provided so as to prevent the movable plate 20 from moving to the right as shown in FIG. 6, the screw bolt 15 can be readily inserted or screwed in when the terminal unit is assembled and when the movable plate 20 is fastened by the screw bolt 15 and the bushing 21, the limit stop corners 35 and 36 can be released from the respective angled portions 30 and 31 so that the movable plate 20 can be located in a pre-loaded state for cover removal detection.

Furthermore, since the movable plate 20 moves by the force of the spring member 33 when the screw bolt 15 is taken off, the screw hole 49 of the bushing 21 having been in mesh with the screw bolt 15 is closed by the angled portion 22 of the movable plate 20 so that the screw bolt 15 cannot be screwed in again. Therefore, the condition of the screw bolt 15 being removed remains as certain evidence and the condition is indicated to the head end unit. Conventionally, there have been cases where the subscriber returns the cover to its initial position after removing the cover from the terminal unit to alter the interior mechanism for a short period and insists "I have never opened the cover." In accordance with the present invention, the status of the terminal unit can be monitored in a secure fashion. However if it is desired that the unauthorized person not know that his tampering has been detected, a different release mechanism can be used, or a second offset hole in the upper portion 22 of the movable plate 20 can be used.

Furthermore, since control holes are provided to pass through the cover and the chassis (housing) to permit a rod to be inserted and to push the movable plate, the movable plate having moved by the force of the spring member can be readily returned to its initial position. The mechanism such that the cover removal detecting section can be reset by utilizing the control holes is hardly recognized by the subscriber or third party, whereas repairmen or service men who are well aware of it can readily reset the cover.

Although the combination of the control holes 52 and 53 and the rod 54 has been illustrated and described, the combination of a key and a key hole well known may be alternatively provided. In this case, if the subscriber or third party becomes aware of the mechanism, the cover removal detecting section cannot be reset without the key.

What is claimed is:

1. A terminal unit for CATV systems comprising a terminal unit housing for containing circuit parts or the like, a terminal unit cover for closing said housing, coupling means for coupling said housing and said cover, electromechanical detecting means for detecting release of said coupling means, said detecting means including means shifting to a position in which said coupling means cannot recouple said housing and said cover after release of said coupling means, a signal generator circuit for generating signals in response to the detection of operation of said detecting means, and a signal transmitting circuit for transmitting the output signal from said signal generator circuit to the head end so as to indicate the release of said coupling means to the head end.

2. A terminal unit for CATV systems as set forth in claim 1, wherein said detecting means comprise a lever coupled within said housing with said housing and said cover, said lever including means for engaging said coupling means, a spring member for moving said lever to a predetermined position when said lever is released from said coupling means, and a switch disposed to be actuated by said lever when said lever is moved by the force of said spring member to the predetermined position.

3. A cover removal detecting apparatus for CATV terminal units comprising a housing for containing circuit parts or the like, a cover for closing said housing, a screw bolt for coupling said housing and said cover together, a movable plate including a screw hole for fixture to said housing and/or said cover in a unit by means of said screw bolt, a spring member for moving said movable plate to a predetermined position when said movable plate is released from said screw bolt, switch means operable when said movable plate moves by the force of said spring member to the predetermined position, and alignment limit means for retaining said movable plate against the force of said spring member to place the screw hole in said movable plate in a position capable of receiving said screw bolt when said movable plate is to be fastened by said screw bolt, so that said movable plate itself moves toward the head portion of said screw hole with the movement of said screw bolt into said screw hole so as to release from the engagement with said limit means.

4. A cover removal detecting apparatus for CATV terminal units comprising a housing for containing circuit parts or the like, a cover for closing said housing, a screw bolt for coupling said housing and said cover, a movable plate including a screw hole for fixture to said housing and/or said cover in a unit by means of said screw bolt, a spring member coupled to said movable plate for moving said movable plate to a predetermined position displaced from alignment with said screw bolt when said movable plate is released from said screw bolt, switch means operable by said movable member when said movable plate moves toward the predetermined position by the force of said spring member, limit means for retaining said movable plate in the predetermined position to place the screw hole in a position incapable of receiving said screw bolt, so that at least one of the holes formed in said housing and said cover can be closed to the screw bolt to prevent said screw bolt from being screwed again thereinto.

5. A cover removable detecting apparatus fo CATV terminal units comprising a housing for containing circuit parts or the like, a cover for closing said housing, a screw bolt for coupling said housing and said cover, a movable plate including a screw hole for coupling said housing and/or said cover in a unit by means of said screw bolt, a spring member for moving said movable plate to a predetermined position in which the screw hole is incapable of receiving the screw bolt when said movable plate is released from said screw bolt, switch means operable when said movable plate moves by the force of said spring member, alignment limit means for restraining said movable plate against the force of said spring member to place the screw hole formed in said movable plate in an alignment position capable fo receiving said screw bolt when said movable plate is to be fastened by said screw bolt, and at least one of said housing and said cover including a control hole for effecting an external control such that said movable plate having moved by the force of said spring member can be pushed against the force of said spring member to the position where said movable plate is retained by said alignment limit means so that the screw bolt can be reinserted.

6. In a CATV terminal having cover means that may be removed relative to a housing to which it is coupled, a device for providing an electrical signal indicating removal of the housing by removal of a fastener coupling the cover to the housing comprising:

a support member shiftable parallel to a shift axis and including means engaging the interior end of the fastening means and movable thereby in a direction normal to the shift axis and toward the cover;

mechanical biasing means coupling the support member to a region fixed relative to the housing, to tend to move the support member in a selected direction along the shift axis;

the support member including limit stop surfaces substantially normal to the shift axis;

fixed stop members engaging the limit stop surfaces when the support member is in a first position not engaged by the fastener, and free of the limit stop surfaces when the support member is engaged by said fastener and drawn toward said cover and housing means, whereby the support member is free to shift under the force of the biasing means along the shift axis in the event the fastening means is withdrawn;

switch means fixed relative to said chassis; and means coupled to the support member for engaging said switch means to provide a changed circuit condition when the support member is shifted along the shift axis.

7. The invention as set forth in claim 6 above, wherein said fastening means comprises a screw bolt and wherein said device further includes bushing means disposed interior to the housing and in fixed relation thereto for receiving the interior end of said screw bolt, and said support member includes means engaging the screw bolt when inserted and arranged to allow the support member to shift along the shift axis upon removal of the screw bolt.

8. The invention as set forth in claim 7 above, wherein said support member includes a portion disposed adjacent the housing and alignment hole for alignment with the screw bolt, in the normal position of operation, wherein said support member includes a pair of apertures defining the limit stop surfaces, and the stop means comprises a pair of fixed members, each engaging a different one of the stop surfaces in the appropriate position of operation.

* * * * *

UNITED STATES PATENT AND TRADEMARK OFFICE

CERTIFICATE OF CORRECTION

PATENT NO. : 4,149,158

DATED : April 10, 1979

INVENTOR(S) : Takeshi Iwaoka and Shigeki Koike

It is certified that error appears in the above-identified patent and that said Letters Patent are hereby corrected as shown below:

Column 1, line 26, after "subscriber" and before "view", "an" should read --can--. Column 2, line 8, "scre whole" should read --screw hole--. Column 3, line 36, before "when", "in" should read --on--; line 60, after "whereas" and before "switch", "th" should read --the--. Column 4, line 19, after "bolt" and before "and", "5" should read --15--; line 56, after "is" (first occurrence), "out" should read --put--. Column 6, line 4, after "the" and before "40", "swtich" should read --switch--; line 15, after "the" and before "A", "row" should read --arrow--; line 19, after "plate" and before "moves", "2" should read --20--; line 26, after "cover" and before "the" (second occurrence), "for" should read --from--; line 52, after "However" and before "if", insert a comma --,--. Column 7, line 18, after "signal" (first occurrence), and before "said", "from" should read --of--. Column 8, line 1, after "apparatus" and before "CATV", "fo" should read --for--; line 14, after "capable" and before "re-", "fo" should read --of--.

Signed and Sealed this

*Seventeenth* Day of *July 1979*

[SEAL]

*Attest:*

*Attesting Officer*

LUTRELLE F. PARKER

*Acting Commissioner of Patents and Trademarks*